US012599171B2

(12) United States Patent
Spellman

(10) Patent No.: US 12,599,171 B2
(45) Date of Patent: Apr. 14, 2026

(54) MULTI-PORTION VAPING DEVICE

(71) Applicant: Edward F. Spellman, Lakewood, OH (US)

(72) Inventor: Edward F. Spellman, Lakewood, OH (US)

(73) Assignee: Edward F. Spellman, Lakewood, OH (US)

( * ) Notice: Subject to any disclaimer, the term of this patent is extended or adjusted under 35 U.S.C. 154(b) by 303 days.

(21) Appl. No.: 18/137,208

(22) Filed: Apr. 20, 2023

(65) Prior Publication Data

US 2023/0337734 A1 Oct. 26, 2023

Related U.S. Application Data

(60) Provisional application No. 63/332,739, filed on Apr. 20, 2022.

(51) Int. Cl.

| | |
|---|---|
| ***A24F 40/42*** | (2020.01) |
| ***A24F 40/30*** | (2020.01) |
| ***A24F 40/46*** | (2020.01) |
| ***A24F 40/485*** | (2020.01) |

(52) U.S. Cl.

CPC ..... *A24F 40/42* (2020.01); *A24F 40/30* (2020.01); *A24F 40/46* (2020.01); *A24F 40/485* (2020.01)

(58) Field of Classification Search

None

See application file for complete search history.

(56) References Cited

U.S. PATENT DOCUMENTS

| | | | | |
|---|---|---|---|---|
| 6,418,936 | B1 * | 7/2002 | Lee | A24F 5/00 131/330 |
| 2012/0204888 | A1 * | 8/2012 | Descamp | A24F 1/00 131/180 |
| 2017/0251718 | A1 * | 9/2017 | Armoush | A24F 40/40 |
| 2018/0098569 | A1 * | 4/2018 | Martin | A61M 15/06 |
| 2018/0228211 | A1 * | 8/2018 | Eckhoff | A24F 5/10 |
| 2020/0046025 | A1 * | 2/2020 | Otiaba | A24F 40/57 |
| 2021/0177049 | A1 * | 6/2021 | Liu | A24F 5/04 |
| 2023/0132847 | A1 * | 5/2023 | Thomas | A24F 1/32 131/173 |
| 2023/0263217 | A1 * | 8/2023 | Horowitz | A24F 40/44 131/328 |
| 2023/0284679 | A1 * | 9/2023 | Kasanjian-King | A24F 5/00 |

* cited by examiner

*Primary Examiner* — Philip Y Louie
*Assistant Examiner* — Morgan Faith Dezendorf
(74) *Attorney, Agent, or Firm* — Edward F. Spellman

(57) ABSTRACT

A multi-portion vaping device with a carrier and a removable cartridge mounted to the carrier. The cartridge supporting a plurality of herb bowls each sized to contain a spectrum of a herb compound to allow a user to inhale a vapor of the herb compound. A herb bowl is selected by rotating the cartridge's cylinder plate to a different location in the cartridge each time the user desires to inhale vapor from an unused herb bowl. The cartridge is easily removed from and installed in the carrier.

16 Claims, 12 Drawing Sheets

MULTI-PORTION VAPING DEVICE

CROSS-REFERENCE TO RELATED APPLICATIONS

This application claims the benefit of U.S. Provisional Patent Application No. 63/332,739 filed on Apr. 20, 2022, which is incorporated in its entirety herein by reference.

TECHNICAL FIELD

Embodiments of the technology relate generally to a Multi-portion Vaping Device that has: 1) provisions to hold multiple portions of a plant material to vaporize, 2) a means to select which portion will be vaporized, 3) a means to supply heated air to vaporize said material via convective heating, and 4) a means to allow the user to consume, via inhalation, aerosols and volatile organic compounds (VOCs) of said material.

BACKGROUND

For the purpose of this invention the following definitions apply:

"Aerosol" is a suspension of fine solid particles or liquid droplets in air or another gas.

"Volatile organic compounds (VOCs)" are organic chemicals that have a high vapor pressure at ordinary room temperature.

"Vaping" is the act of inhaling and exhaling a mixture of aerosols and VOCs, often referred to as vapor, which is produced by heating fresh herb, and/or herb extract, to a temperature that is below its combustion point. This vapor is not smoke, in that no combustion has taken place.

"Device" is an instrument, appliance, or apparatus designed for a specific operation; in this case, the specific operation is vaping.

"Fresh herb", as known as herb, dry herb, and flower, is plant material that has been prepared by first drying to a specific reduced moisture content and then grinding to yield a product suitable for vaping. Herb usually means marijuana, i.e., cannabis, but could also be other plants that are vaped for medicinal benefits, e.g., thyme, basil, lemon balm, eucalyptus, peppermint, etc.

"Spent herb" is herb that has been vaped, that is, most of the essential oils and VOCs have been removed.

"Concentrates" are concentrated cannabinoids, flavonoids, and terpenes separated from cannabis plant material.

To date over 70 different cannabinoids (with tetrahydrocannabinol (THC) and cannabidiol (CBD) being the most commonly known), 120 different terpenoids (terpenes), and 23 different flavonoids have been identified as being present in cannabis plants. Cannabinoids, terpenes, and flavonoids are the compounds of the plant that produce the sought-after pharmacological effects. How these compounds interact with each other, and with the consumer's physical and mental states, is not fully understood. Each strain of cannabis will have a different proportion of these compounds which will produce unique effects, both beneficial and sometimes negative, for the consumer.

Due to the known health risks that smoking presents, a growing population of both medical and recreational marijuana users are choosing to consume compounds of this plant via vapor inhalation, i.e., vaping. Vaping devices are ideal for these users since they allow for convenient, controlled, and repeatable consumption of this drug.

Vaping devices are designed to work with either fresh herb or concentrates; some devices can accommodate both. The advantage to vaping fresh herb over concentrates is that the user gets to sample the full spectrum of cannabinoids, terpenes, and flavonoids that are present in the plant. Some of these compounds can be removed, altered, or destroyed, either advertently or inadvertently, during the concentrate manufacturing processes. Many concentrates are cut, i.e., diluted, with carriers such as glycerin or propylene glycol. Also, any undesirable contaminates, e.g., heavy metals and pesticides, that are present on, or in, the plant material will also be concentrated, sometimes to dangerous levels.

As of this writing, 40 US states have legalized the use of medical marijuana and 21 states have legalized recreational (adult use) marijuana. To date, 41 countries have either decriminalized or legalized adult use marijuana; multiple other states and countries are in the process of doing so.

Vaping devices can be classified into three broad categories, depending on how the herb bed is heated—conduction, convection, and a combination of both conduction and convection. Conduction devices make use of an oven-like chamber to heat the herb. Convection devices heat the inhalation air, which in turn heats the herb. Hybrid devices use both heating methods to form the vapor. Of the three heating methods, convection is considered the most desirable because heat is applied to the herb bed only when inhalation air for vaporization is flowing through it, while conduction devices continuously heat or "bake" the herb when powered on.

Vaping devices can also be classified by how the heat for vaporization is generated; currently, two methods are commercially available-combustion and electric resistive. Combustion uses a flame source to heat herb or concentrate to a temperature that is above the vaporization point, but below the combustion point of the material. Electric resistive vaping devices use that heat generated by an electric current flowing through a wire, or thin conductive foil, to heat the herb or concentrate. This electric current is usually supplied by a battery, or batteries, contained in the device. Electric resistive vaping devices are more complex, and thus more expensive, than combustion vaping devices, but produce a more accurate and repeatable vaporization temperature and are, by far, the most common type of vaping devices.

SUMMARY OF THE INVENTION

In accordance with the present invention, a multi-portion vaping device has a carrier and a removable cartridge (cylinder assembly) mounted to the carrier. The cartridge contains a plurality of herb bowls, each of which contain a spectrum of a herb compound to allow a user to inhale a vapor of the herb compound. A herb bowl is selected by rotating the cartridge's cylinder plate to a different location in the cartridge each time the user desires to inhale vapor from an unused herb bowl. The cartridge is easily filled with fresh herb, emptied of spent herb, and disassembled for cleaning. The cartridge is easily removed from and installed in the carrier.

Further in accordance with the present invention, a multi-portion vaping device comprises a carrier means and a removable cartridge means mounted to the carrier means. The cartridge means supports a plurality of herb bowls each sized to contain a spectrum of a herb compound to allow a user to inhale a vapor of the herb compound. Herb bowl means are selected by rotating the cartridge's cylinder plate means to a different location in the cylinder means each time the user desires to inhale vapor from an unused herb bowl.

The cartridge means can be easily removed from and installed in the carrier means.

Still further in accordance with the present invention, a method of vaporizing a herb compound comprising the following steps. Providing a carrier having a removable cartridge mounted thereto. Supporting a plurality of herb bowls each sized to contain a spectrum of the herb compound in the cartridge to allow a user to inhale a vapor of the herb compound. Rotating the cartridge's cylinder plate to a different location in the cartridge each time the user desires to inhale vapor from an unused herb bowl. Easily installing and removing the cartridge from the carrier means.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity. Components that are "sliced" in cross-sectional views are not hatched.

Figure 1:
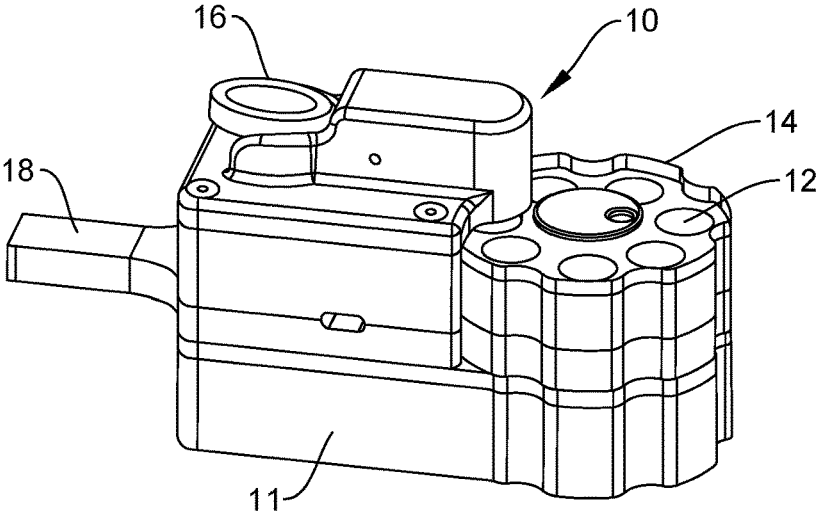

In some cases, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

In the figures, herb bowls are shown as empty; the device bowls will contain herb during use.

FIG. 1 is a side isometric view of the multi-portion vaping device which consists of a carrier and a removable cartridge (cylinder assembly), according to the present invention.

Figure 2:
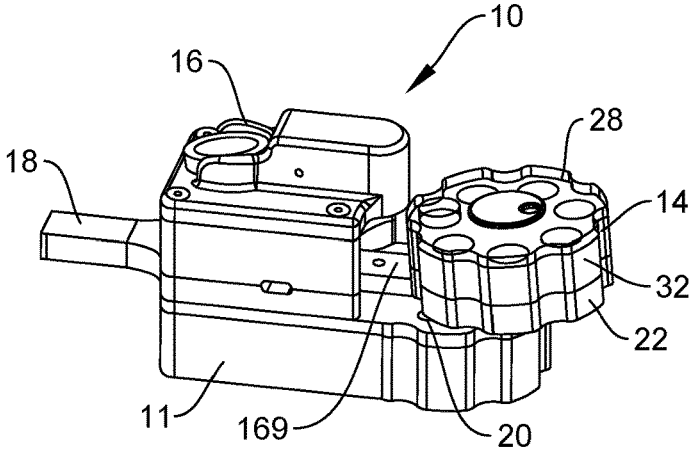

FIG. 2 is a side isometric view of the multi-portion vaping device with the cylinder assembly partially separated from carrier, according to the present invention.

Figure 3:
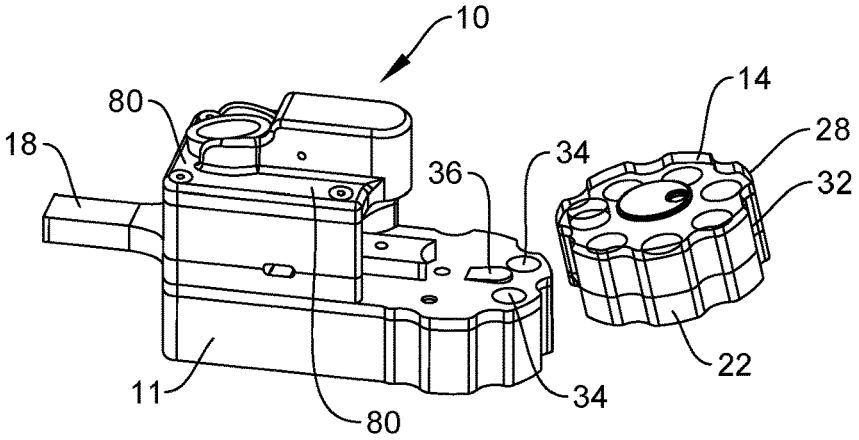

FIG. 3 is a side isometric view of the multi-portion vaping device with the cylinder assembly completely separated from carrier, according to the present invention.

Figure 4:
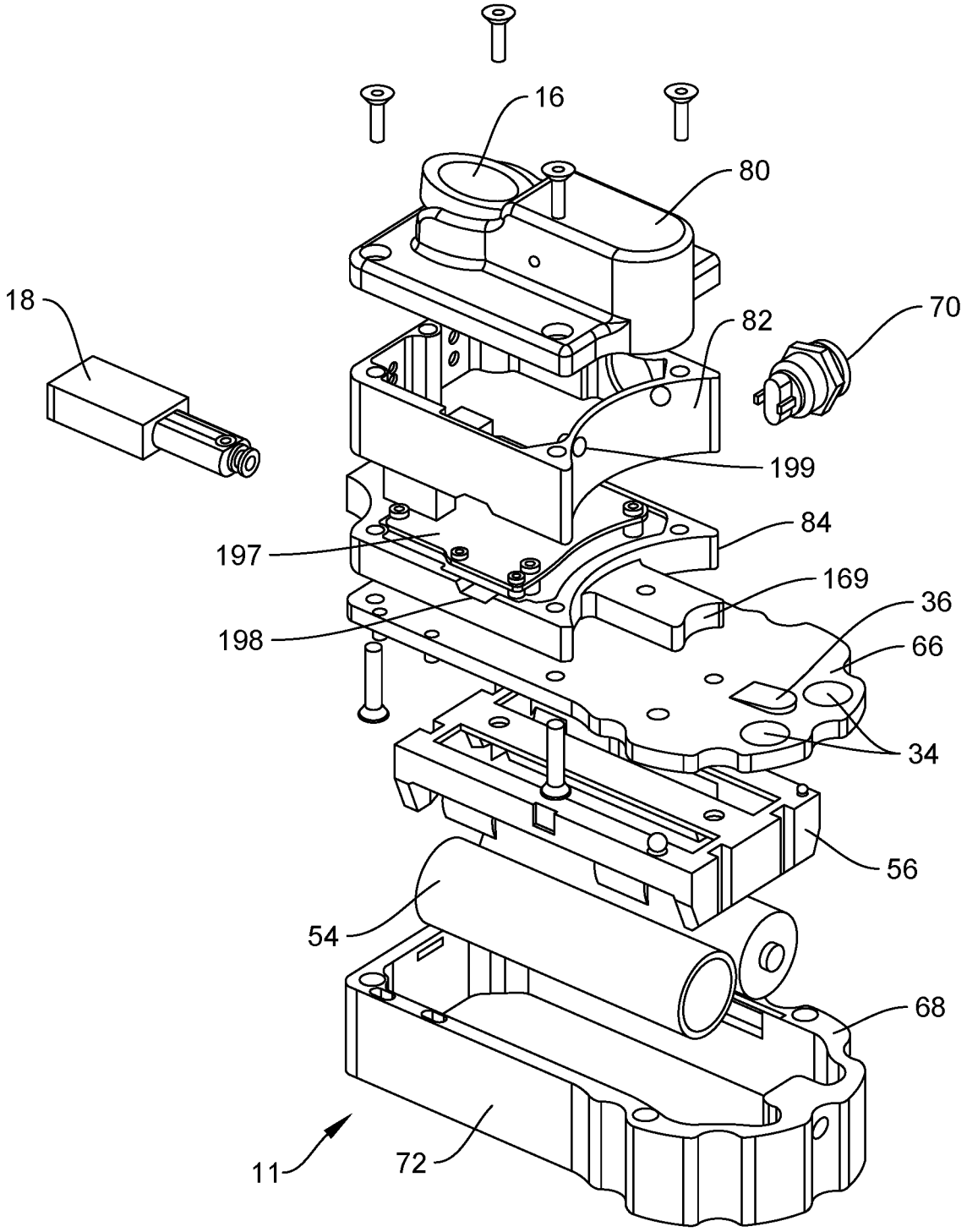

FIG. 4 is an exploded side isometric view of the carrier of the multi-portion vaping device, according to the present invention.

Figure 5:
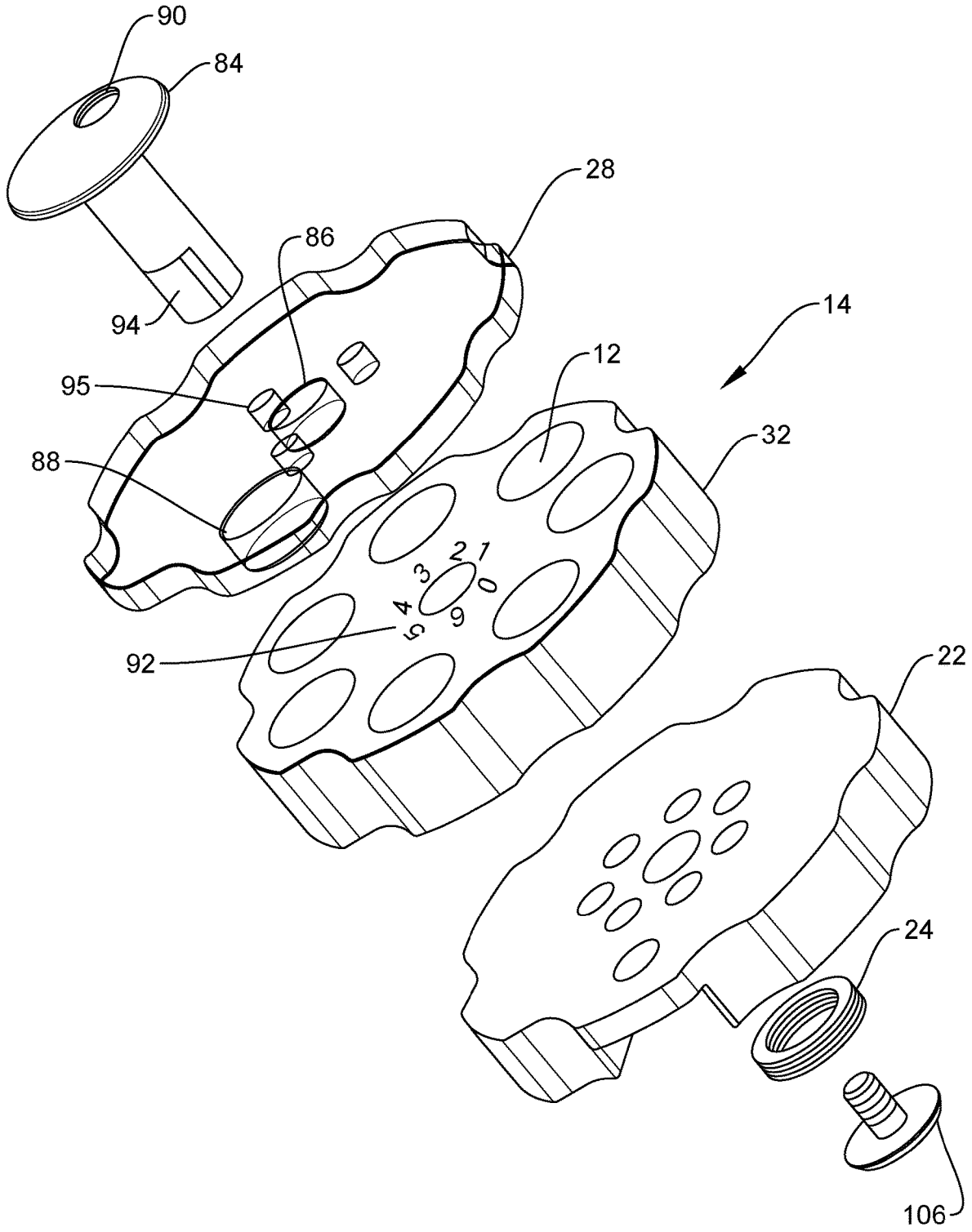

FIG. 5 is an exploded side isometric view of the cylinder assembly, according to the present invention.

Figure 6:
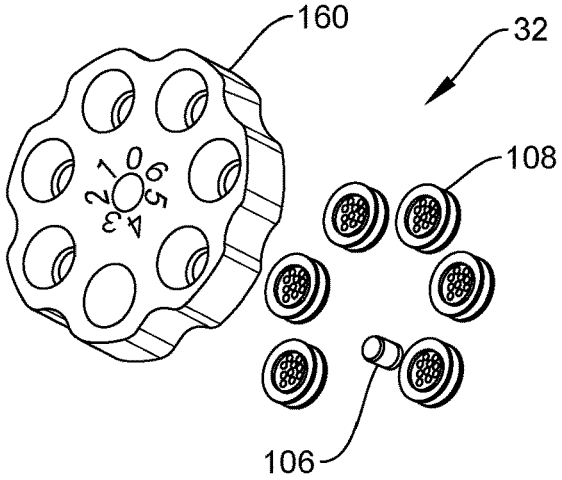

FIG. 6 is an exploded top isometric view of the cylinder plate assembly, according to the present invention.

Figure 7:
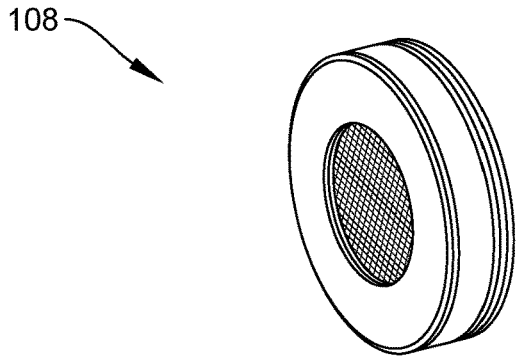

FIG. 7 is a side isometric view of the bed support assembly, according to the present invention.

Figure 8:
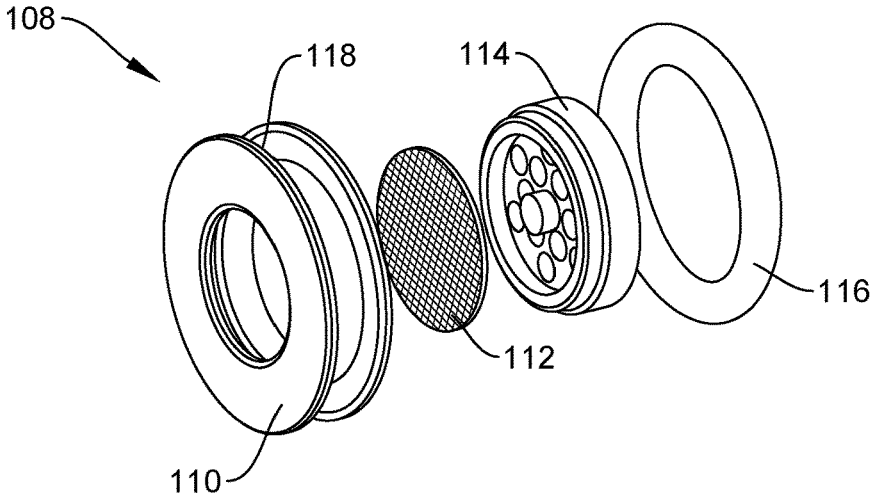

FIG. 8 is an exploded side isometric view of the bed support assembly, according to the present invention.

Figure 9:
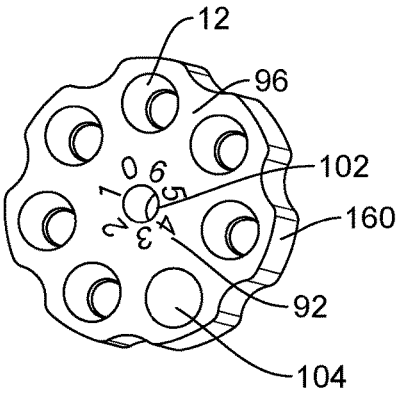

FIG. 9 is a top isometric view of the cylinder plate, according to the present invention.

Figure 10:
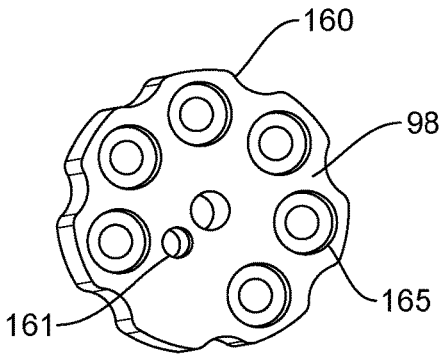

FIG. 10 is a bottom isometric view of the cylinder plate, according to the present invention.

Figure 11:
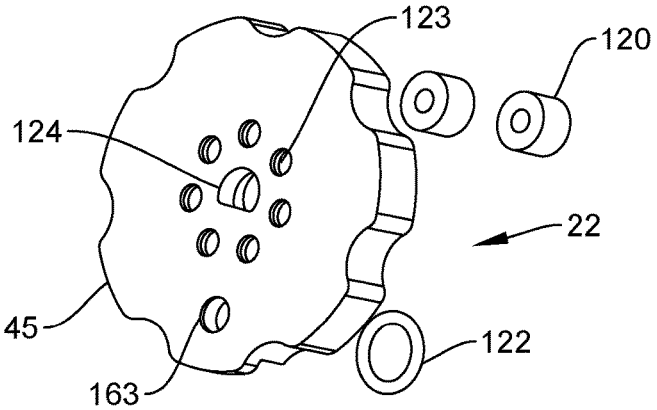

FIG. 11 is an exploded top isometric view of the cylinder bottom assembly, according to the present invention.

Figure 12:
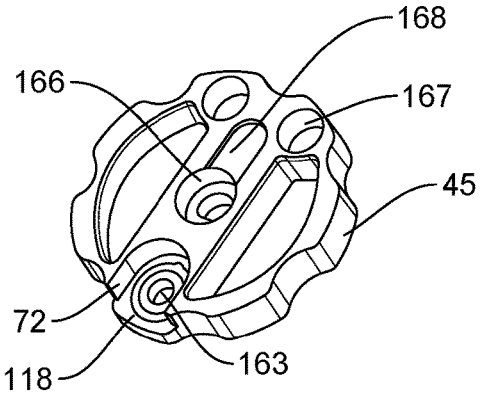

FIG. 12 is a bottom isometric view of the cylinder bottom, according to the present invention.

Figure 13:
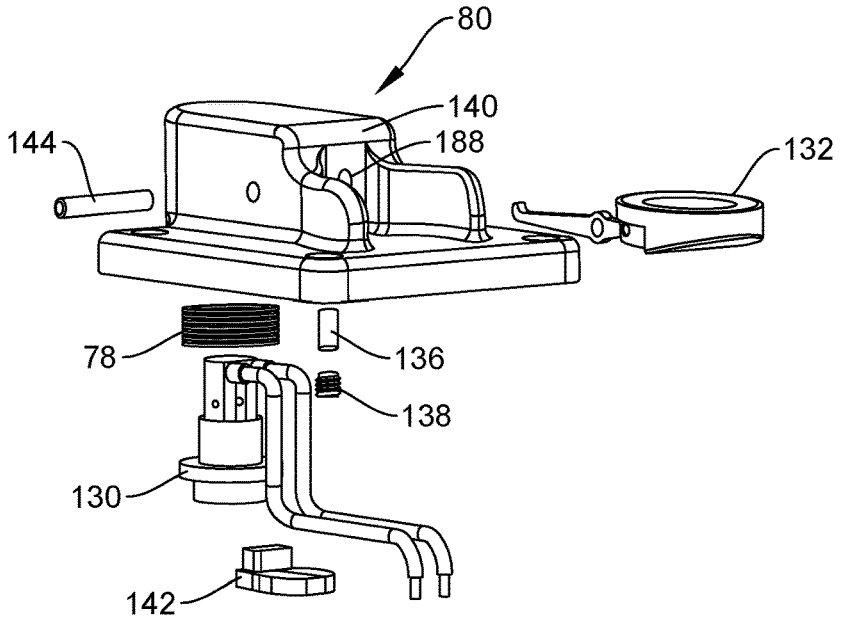

FIG. 13 is an exploded back isometric view of the cap assembly, according to the present invention.

Figure 14:
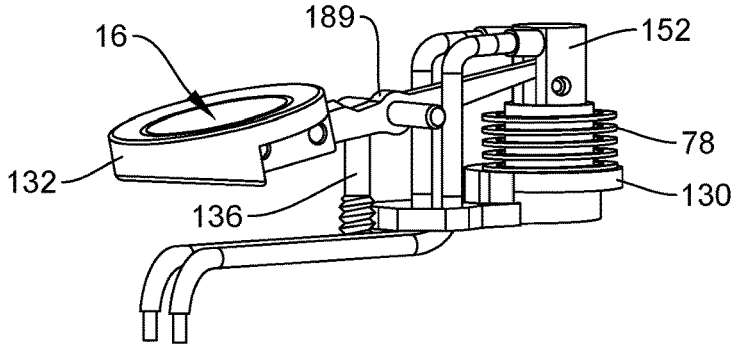

FIG. 14 is a side isometric view of cap assembly, with the cap not shown and the release button depressed, according to the present invention.

Figure 15:
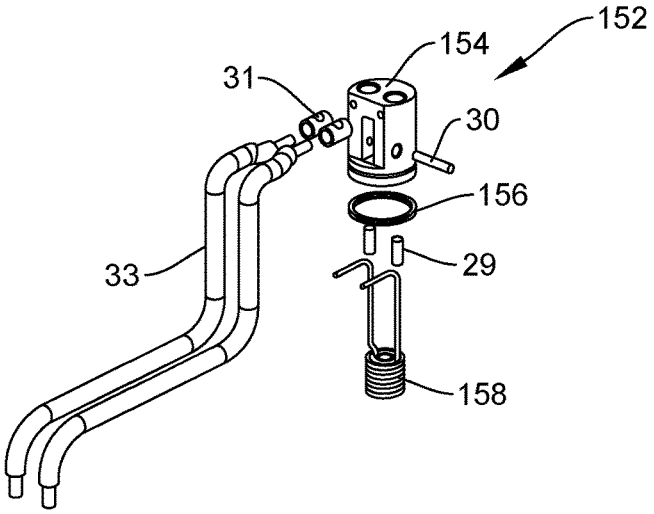

FIG. 15 is an exploded side isometric view of the heater assembly, according to the present invention.

Figure 16:
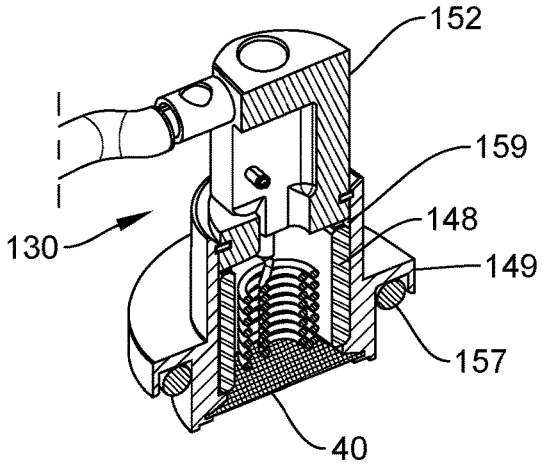

FIG. 16 is a center plane cross-sectional side isometric view of the cap peg/heater assembly, according to the present invention.

Figure 17:
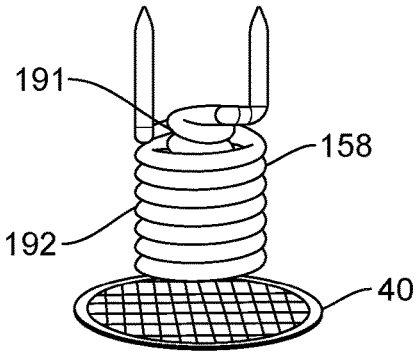

FIG. 17 is a top isometric view of the heater coil and the grid screen, according to the present invention.

Figure 18:
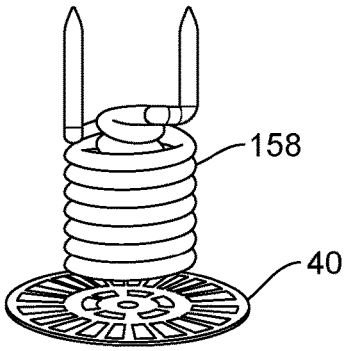

FIG. 18 is a top isometric view of the heater coil and the radial slot screen, according to the present invention.

Figure 19:
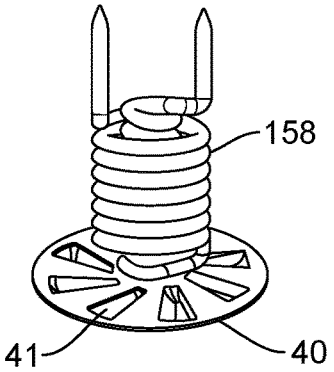

FIG. 19 is a top isometric view of the heater coil and the canted slot screen, according to the present invention.

Figure 20:
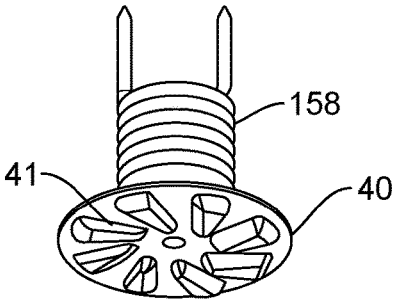

FIG. 20 is a bottom isometric view of the heater coil and the canted slot screen, according to the present invention.

Figure 21:
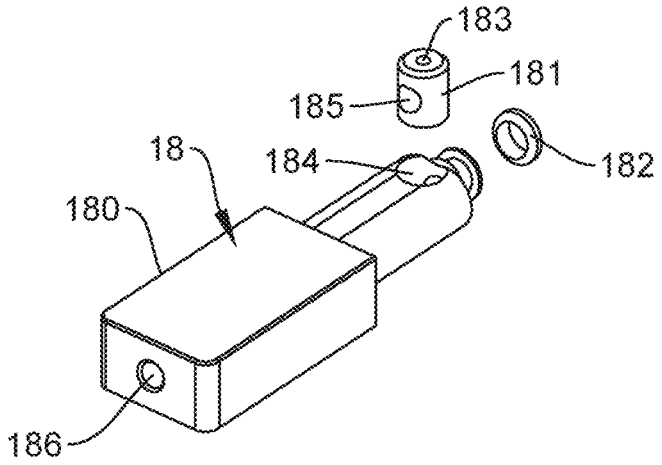

FIG. 21 is an exploded side isometric view of the mouthpiece assembly, according to the present invention.

Figure 22:
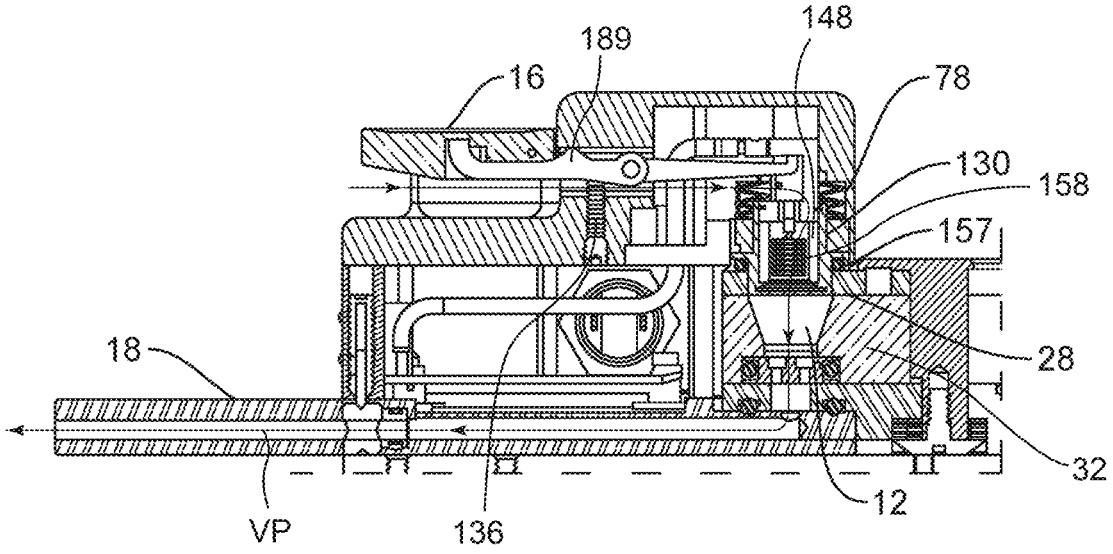

FIG. 22 is a portion of a center plane cross-sectional side view of the multi-portion vaping device, with the release button released, that contains the air and vapor flow path, according to the present invention.

Figure 23:
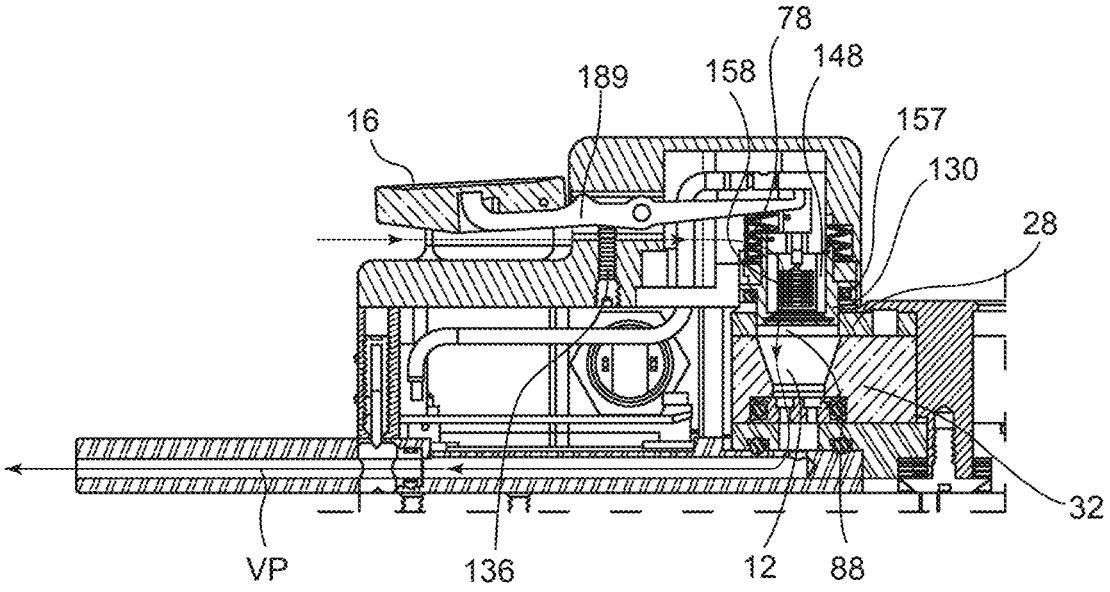

FIG. 23 is a portion of a center plane cross-sectional side view of the multi-portion vaping device, with the release button partially depressed, that contains the air and vapor flow paths, according to the present invention.

Figure 24:
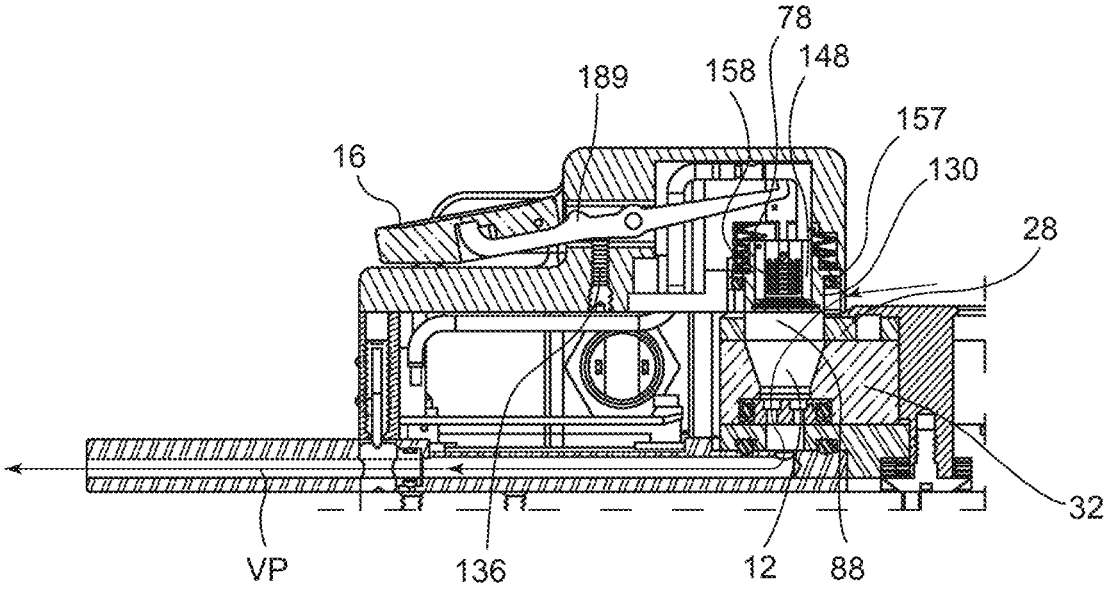

FIG. 24 is a portion of a center plane cross-sectional side view of the multi-portion vaping device, with the release button fully depressed, that contains the air and vapor flow paths, according to the present invention.

FIGS. 25-34 show a variation of the multi-portion vaping device that makes use of a cylinder assembly that has the fresh herb bowls integrated into the bed support assemblies, instead of being a part of the cylinder plate, according to the present invention.

Figure 25:
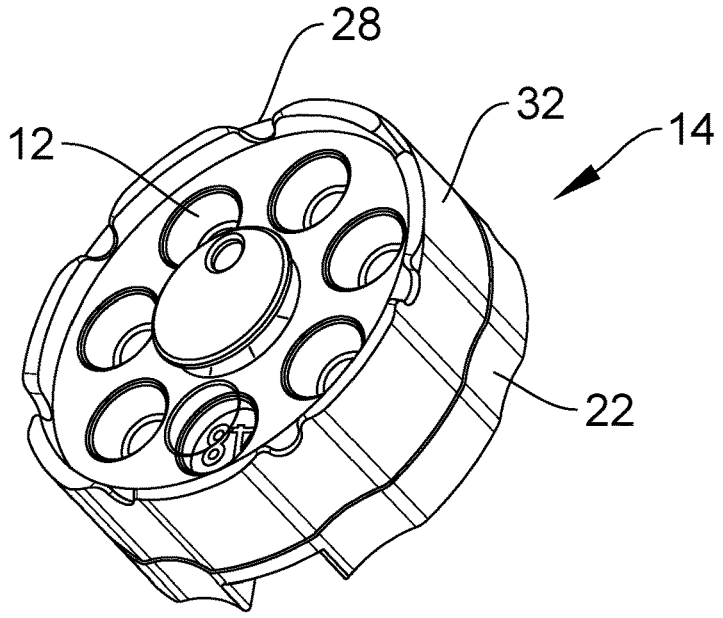

FIG. 25 is a side isometric view of the cylinder assembly, according to the present invention.

Figure 26:
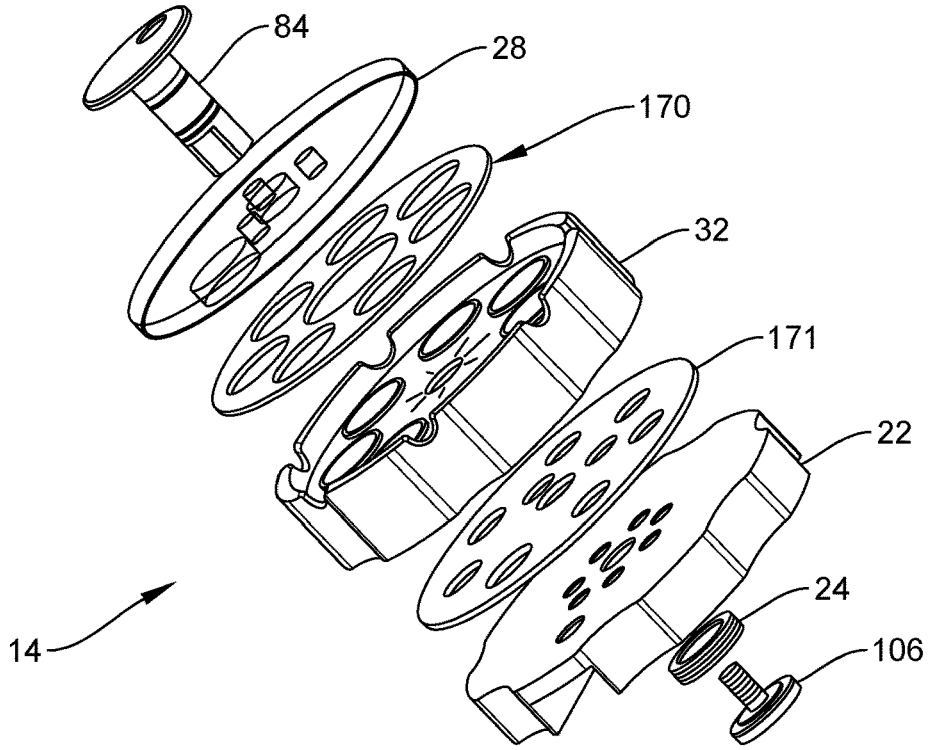

FIG. 26 is an exploded side isometric view of the cylinder assembly, according to the present invention.

Figure 27:
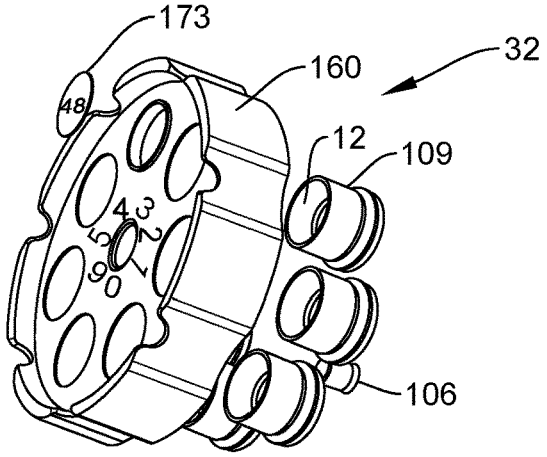

FIG. 27 is an exploded side isometric view of the cylinder plate assembly, according to the present invention.

Figure 28:
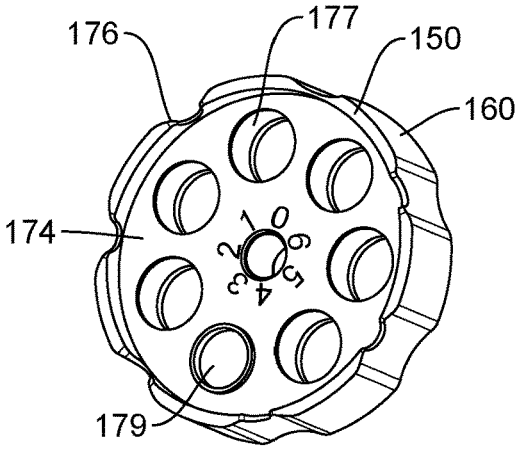

FIG. 28 is a top isometric view of the cylinder plate, according to the present invention.

Figure 29:
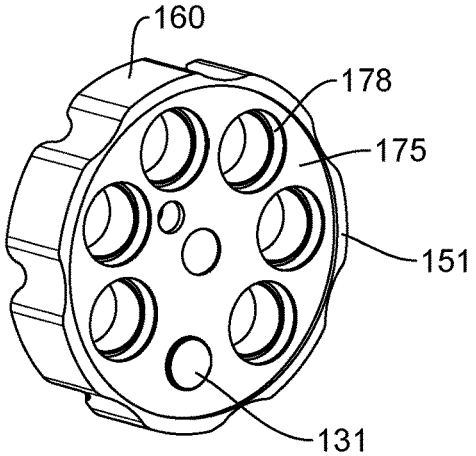

FIG. 29 is a bottom isometric view of the cylinder plate, according to the present invention.

Figure 30:
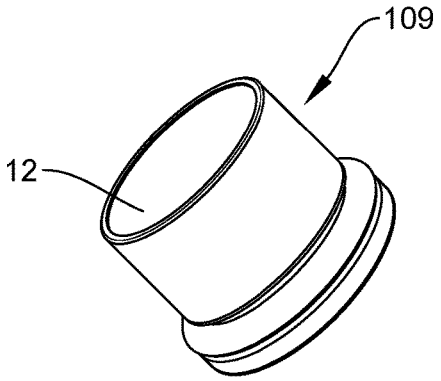

FIG. 30 is a side isometric view of the bowl/bed support assembly, according to the present invention.

Figure 31:
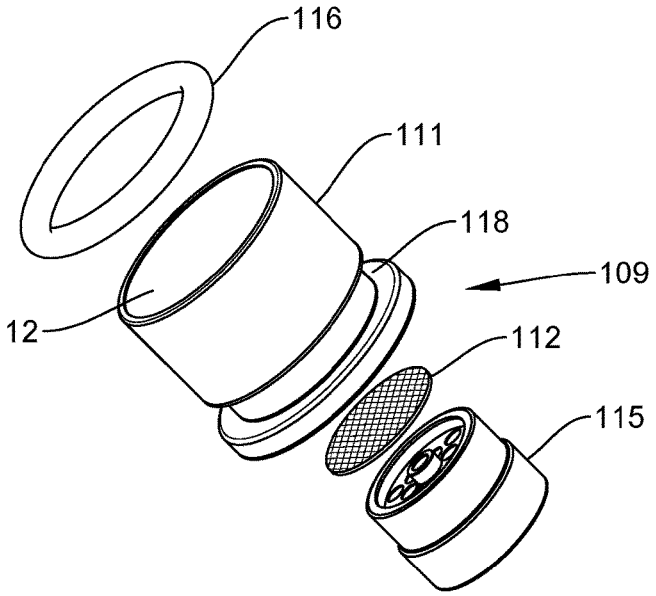

FIG. 31 is an exploded side isometric view of the bowl/bed support assembly, according to the present invention.

Figure 32:
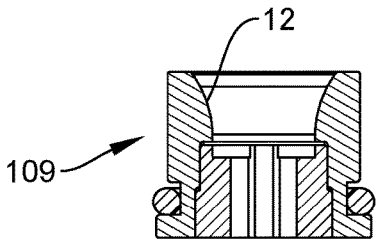

FIG. 32 is a center plane cross-sectional side view of the small volume bowl/bed support assembly, according to the present invention.

Figure 33:
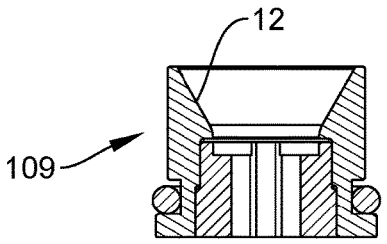

FIG. 33 is a center plane cross-sectional side view of the medium volume bowl/bed support assembly, according to the present invention.

Figure 34:
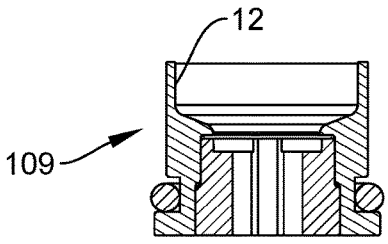

FIG. 34 is a center plane cross-sectional side view of the large volume bowl/bed support assembly, according to the present invention.

DESCRIPTION OF THE INVENTION

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

According to the present invention, there is disclosed a multi-portion vaping device 10 including small, single portion bowls 12 to allow the user to inhale a vapor containing a full spectrum of the herb's targeted compounds, e.g., cannabinoids and terpenes, in a single, or a few, inhalation (s). This makes for a perfect way to titrate, i.e., dose these compounds, or to sample different herb varieties.

The vaping device 10 consists of two (2) main components-a carrier 11 and a removable cartridge (cylinder assembly) 14. In use, the user installs the cartridge 14, which has been loaded will fresh herb, selects a bowl 12, selects a heater coil temperature setpoint, depresses the "Fire" button 70 and inhales after waiting a few seconds for the heater coil 158 to heat up.

As shown in FIGS. 2 and 3, cartridge 14, which contains multiple bowls 12, is easy to remove from, and install in, carrier 11. Removal and installation of a cartridge only requires release button 16 to be depressed while the cartridge is pulled out for removal from the carrier 11 or pushed in for installation into the carrier 11.

O-rings 122 and 157 (see FIGS. 11 and 16, respectively) make air tight seals between the cartridge 14 and the carrier 11.

FIG. 5 is an exploded top isometric view of the cartridge (cylinder assembly) 14, which consists of: cylinder pin 84, cylinder top plate 28, cylinder plate assembly 32, which contains the bowls 12, cylinder bottom assembly 22, spring 24 and tie screw 106.

The cylinder top plate 28 is made from a flat, transparent material, e.g., tempered borosilicate glass, polycarbonate plastic Center bore 86 is used to align the center axis of cylinder pin 84 with the center axis of this plate. Hole 88 in the cylinder top plate 28 is used to both fill fresh herb into, and empty spent herb from, the cartridge (cylinder assembly) 14. Hole 88 is approximately the same diameter as the largest bowl 12 diameter in the cylinder plate assembly 32. A hole 90 in the head of cylinder pin 84 acts as a viewing port for bowl identification numbers 92 on the surface of the cylinder plate 160.

Cylinder top plate 28 and cylinder pin 84 have provisions, e.g., holes 95 for pins or adhesive injection, key & key way, flats, splines, etc., to prevent relative rotary movement between these two components.

Similarly, a flat 94 on the cylinder pin 84, keys this component, and thus the cylinder top plate 28, to the cylinder bottom assembly 22, via the "D" shaped center hole 124 (see FIG. 11), to virtually stop any relative rotary movement while still allowing for a fixed amount of relative axial movement between the top plate 28 and the cylinder bottom assembly 22.

FIG. 6 is an exploded top view of cylinder plate assembly 32, which consists of a cylinder plate 160, six (6) bed support assemblies 108, and spring plunger 106.

Cylinder plate 160 can be made of a high temperature, low friction, and low thermal conductivity material such as Teflon. Top and bottom surfaces 96 and 98 of cylinder plate 160, respectively, are formed or machined flat, smooth, and parallel so that the components that are in contact with these surfaces, i.e., the cylinder top plate 28 and the cylinder bottom assembly 22, form a fairly tight seal with this plate 160 when loaded with the spring 24.

Cylinder plate 160 has a center bore 102 which is perpendicular to top surface 96 and to bottom surface 98 and is sized so that there is a sliding fit between it and cylinder pin 84. Cylinder plate 160 has six (6) bowls 12 and a blank bowl 104. Bowls 12 can be tapered to allow for easier filling and emptying and to avoid flow dead spots. Dead spots are portions of the herb bed that have little, or no, vaporization air flow and therefore results in lower vaporization efficiency. Bowl volume is dictated by geometry; differ bowl diameters, heights, and taper angles will yield different volumes, i.e., herb capacities. Blank bowl 104 can be nothing but a blank spot in cylinder plate 160 or can be depressed slightly from top surface 96 to allow for some sort of cylinder assembly identification marking, e.g., number, letter, symbol, or color patch.

Top surface 96 of the cylinder plate 160 has slightly depressed, equally spaced bowl identification numbers 92, "0" for the blank bowl and "1"-"6" for the remaining bowls. Note that blank bowl identification number "0" is 180 degrees from the center of the blank bowl. This is so when the blank bowl is selected, the "0" is lined-up with hole 90 in the cylinder pin 84.

The six (6) bowls and the blank bowl together are circumferentially equally spaced; therefore, they are 51.4 degrees apart. It is possible to have a cylinder assembly 32 that has more or less than six bowls.

A spring plunger 106 is pressed into a counter bore 161 that is located on the bottom of cylinder plate 160—see FIG. 10. This cylinder spring plunger 106 interfaces with the seven (7) detents 123 in cylinder bottom plate 45 (see FIG. 11) so that the six bowls and blank bowl have a tactile stop when in the proper position.

FIG. 11 is an exploded top isometric view of the cylinder bottom assembly 22 which consists of a cylinder bottom plate 45, two ferrous metal slugs 120, and an O-ring 122. There are the same number of detents 123 as there are bowls, e.g., six (6), +one (1) blank. The detents 123 are sized and positioned to interface with spring plunger 106 (see FIG. 6).

FIG. 12 is a bottom isometric view of cylinder bottom plate 45. A vapor flow hole 163 is located so that it is in-line with hole 88 of cylinder top plate 28. This hole is sized to accept the mouthpiece assembly 18 so that spent herb can be blown from cylinder assembly 14. The O-ring groove 118 is centered on this hole and accepts O-ring 122. Bores 168 accept ferrous slugs 120. Center counterbore 166 provides room for spring 78 and the head of tie screw 106. Female ramp feature 168 helps with the insertion and removal of the cartridge 14 into, and out of, the carrier 11. This female ramp feature 168 also helps to prevent the cartridge 14 from moving when the cylinder plate assembly 32 is rotated during bowl 12 selection.

The transparent cartridge top plate (glass or plastic, e.g., polycarbonate) 28, as shown in FIGS. 2 and 3, allows the user(s) to see the herb status in each bowl 12. In contrast to fresh herb, spent herb will be more brownish in color. This transparent plate 28 can be illuminated with light emitting diodes (LEDs) 199, see FIG. 4, to glow a pleasing blue color when the device is powered on; this blue glow can increase in brightness proportionately with heater coil power, i.e., current flow through the heater coil 158.

Each bowl 12 of cartridge 14 has easy to read identification markings 92, e.g., "0"-"6", as shown in FIGS. 5, 6, and 9. The identification number 92 of the selected bowl 12 will be visible through view port 90 in cylinder pin 84. Also, each cylinder plate 160 has a unique marking located in blank bowl position 104, e.g., colored and/or numbered label. These identification markings allow the user(s) to keep track of what type or strain of herb is loaded into each bowl 12 of each cartridge 14. Users can own more than one cartridge 14. The bowl markings 92 also allow multiple users to know whose turn it is to take a hit.

A bed support assembly 108, as shown in FIGS. 7 and 8 consists of: a flow body 110, a screen 112, a perforated disk 114, and an O-ring 116. All above listed components of the bed support assembly 108 are aligned axially. An O-ring groove 118 of the flow body 110 is sized so that when assembled, O-ring 116 will compress into counter bores 165 of cylinder plate 160 (see FIG. 10) with a light finger pressure. The screen 112 has a mesh fine enough to keep herb from passing through, but not so fine as to result in excessive pressure drop of inhalation vapor flow. Preferred material for screen 112 is stainless steel. Screen 112 has an outside diameter that allows for a slip fit into counter bore of the flow body 110.

Each bed support assembly 108 acts as both a screen and a heat sink to filter and cool the vapor. Therefore, each bed support assembly 108 is heated by, and thus cools, only one or two inhalations.

Bowl selection simply entails rotating the cylinder plate assembly 32 of the cartridge 14. Tactile and audible feedback indicates when a bowl 12 is in the correct position for use.

Each cartridge 14 is virtually air-tight and has a blank bowl position. This allows a cartridge 14 that is filled with fresh and/or spent herb to be stored for use at a later time.

Bowl pads can be installed into the bowls 12 to allow fresh herb to be replaced with concentrates.

Only one (1) tie screw 24 (see FIG. 5) needs to be removed to disassemble the cartridge 14 for a more thorough cleaning of bowls 12 and bed support assemblies 108. This screw is designed to be loosened and tightened with a coin or a coin-shaped driver.

Referring to FIG. 4, there is shown an exploded front isometric view of the carrier 11 which consists of a cap assembly 80, a stand-off assembly 82, a mouthpiece carrier assembly 84, a bottom assembly 66, a battery cover assembly 68, a mouthpiece assembly 18, a button switch 70, battery holder 56, two batteries 54, and a plurality of screws.

Carrier 11 has a simple, "low tech", and intuitive user interface-cartridge release button 16, temperature setpoint select button (not shown), temperature setpoint LEDs (not shown), power on/off and "Fire" button 70, blue heater current LEDs 199, and port 198 for battery charging.

Carrier 11 is battery 54 powered, e.g., two (2) 21700 rechargeable lithium-ion batteries, wired in parallel for long battery life between charges. The printed circuit board (PCB) 197 has on-board battery management, protection, and charging circuitry with battery charge indicator LED. A port 198 (USB-C) allows for fast, e.g., 3-amp, battery charging. The easy-to-remove, i.e., no tools required, battery cover assembly 68 allows for fast and convenient battery swap-outs. If desired, a small screw can be added to lock the battery cover assembly in place so that the batteries are not so easily accessible; consumption lounges may be interested in this option. If desired, a theft protection device, e.g., acousto-magnetic tag, can be integrated into the battery cover assembly 68; consumption lounges may be interested in this option.

Magnets 34, a finger 169, and a male ramp feature 36 interface with cartridge 14 features ferrous slugs 120 (FIG. 11), groove 72, and female ramp feature 168 (FIG. 12) help to ease cartridge installation and removal. Magnets 34, see FIG. 4, also act to hold the cartridge 14 in place when the cartridge release button 16 is fully depressed to keep the cartridge from inadvertently falling out of the carrier. The finger 169, groove 72 and ramp features 36 and 168 also keep the installed cartridge 14 from moving when the cylinder plate assembly 32 is rotated during bowl selection.

FIG. 13 is an exploded back isometric view of the cap assembly 80, which consists of: a cap 140, a cap peg/heater assembly 130, a lever assembly 132, a wave spring 78, compression spring 136, a set screw 138, a wire guide 142, and a pin 144.

Ambient air for herb vaporization first flows into the device 10 through slot 188 in cap 140.

A compression spring 136 and a set screw 138 are used to keep the lever assembly 132 from rattling when the release button is released. Without spring 136 the lever assembly 132 may rattle due to manufacturing tolerances of the various components of device 10.

Lever assembly 132 consists of bar 189 and cartridge release button 16. Bar 189 passes through slot 188 of cap 140, pivots on pin 144, and connects the cartridge release button 16 to the cap peg/heater assembly 130.

FIG. 14 is an isometric view of cap assembly 80 without the cap. A release button 16 is fully depressed. Note that both the wave spring 78 and the compression spring 136 are correctly shown in their fully compressed states.

FIG. 15 is an exploded, isometric view of the heater assembly 152, which consists of: a ceramic heater support 154, a heater coil 158, ceramic stand offs 29, a roll pin 30, wires 33, crimp fittings 31, and a retaining ring 156. The roll pin 30 keeps the lever assembly 132 from returning to its upmost position if the cartridge release button is released before the cartridge 14 is fully inserted and seated properly; this acts as an indication that something is wrong. The retaining ring 156 connects the heater assembly 152 to the cap peg 149. Crimp fittings 31 are used to connect extension wires 33 to the heater coil 158 legs.

FIG. 16 is a center plane cross-sectional side isometric view of the cap peg/heater assembly 130 which consists of: the heater assembly 152, cap peg 149, ceramic sleeve 148, O-ring 157, screen 40, and wave washer 159. Wave washer 159 is used to take-up manufacturing tolerances of the heater support 154, the ceramic sleeve 148, and the cap peg 149 and to compensate for the different thermal expansions of these parts.

A durable, single wire wound coaxial heater coil 158, e.g., 22-gauge 316L stainless steel, is useful in vaporizing the herb. The dimensions of the air gaps through and between the heater coil 158 and the ceramic sleeve 148 results in efficient heat transfer between the coil and the vaporizing, which is also the inhaled, air flow.

As shown in FIG. 17, heater coil 158 is formed from a single length of wire; inner wraps 191 and outer wraps 192 are therefore in series. The total length of the heater coil's wire, the wire diameter, and the wire material will determine the heater coil's electrical resistance at various temperatures. The wire material must have a positive and know Temperature Coefficient of Resistance (TCR) in order for the PCB 197 (see FIG. 4) mounted controller to accurately control the heater coil's temperature. Stainless steel, nickel, and titanium wires can be used to make a controllable heater coil.

The inner and outer coil sections 191 and 192, respectively, wrap diameters are sized for efficient transfer of heat to the inhalation air flowing through the cap peg/heater assembly 130. For a given wire material, wire diameter, and inner and outer wrap diameters, the number of coil wrap turns is dictated by the desired heater coil resistance (ohms).

The screen 40 can be optimized to provide evenly dispersed heated air flow throughout the entire herb bed for efficient vaporization of targeted compounds. One possible design, shown in FIGS. 19 and 20, makes use of perforated, radially canted slots 41 to impart a circumferentially outward component to the air flow so that a herb bowl 12, whose major inner diameter is larger than the ceramic sleeve's 148 inner diameter will still have virtually even air flow throughout the herb bed.

One possible design covered by the present invention is to have either the inner portion 191, the outer portion 192, or both portions of the heater coil 158 in contact with the screen 40 to further increase heat transfer into the air flow.

A printed circuit board (PCB) 197 that is mounted to the mouthpiece carrier assembly 87 and housed in the stand-off assembly 82 (see FIG. 4) contains advanced protection and control circuitry and firmware/software that allows for intuitive, safe device 10 operation and brings the heater coil up to setpoint temperature within a few seconds after depressing the "Fire" button 70.

Among the benefits of the multi-portion vaping device 10 is full convective heating of the herb without the herb being "baked". Only inhalation air comes in contact with the heater coil 158.

A 2-stage air bleed lets the user send thermal pulses through the herb bed, if desired. The amplitude, frequency, and duration of these thermal pulses are controlled by depressing and releasing the cartridge release button 16. Thermal pulses may aid in the release and preservation of desirable compounds, e.g., cannabinoids and terpenes, that are present in the herb. When the cartridge release button 16 is partially depressed, an annular flow of unheated air is introduced into the herb bed. When the cartridge release button 16 is fully depressed, a plug flow of unheated air is introduced into the herb bed.

FIGS. 22-24 are portions of a center plane cross-sectional side view of the multi-portion vaping device that show the inhalation air and vapor flow paths through the device 10.

In FIG. 22 release button 16 is released and is in its upmost position. Spring 78, while shown compressed, should actually be shown extended; it compresses O-ring 157 of the cap peg/heater assembly 130 onto the top surface of cylinder top plate 28.

In FIG. 23 release button 16 is partially depressed. Spring 78, while shown compressed, should actually be shown partially extended. The cap peg/heater assembly 130 is partially lifted and O-ring 157 is no longer in contact with the top surface of top plate 28. Because the bottom portion of cap peg 149 is still in hole 88 in cylinder top plate 28 an annular flow of unheated ambient air is introduced downstream of the heater coil 158, but upstream of the herb bowl 12.

In FIG. 24 release button 16 is fully depressed. Spring 78 is compressed. The cap peg/heater assembly 130 is fully lifted and the bottom portion of cap peg 149 is clear of hole 88 in cylinder top plate 28. A plug flow of unheated ambient air is introduced downstream of the heater coil 158, but upstream of the herb bowl 12.

It is possible to have the bottom portion of the cap peg 149 tapered so that the amount of unheated air that flows in an annular pattern could be more precisely controlled by how far the release button 16 is depressed.

FIG. 21 is an exploded, isometric view of the mouthpiece assembly 18 which consists of a mouthpiece body 180, seal 182, and detent insert 181. Detent insert 181 is used if the mouthpiece body 180 is manufactured for a soft material, e.g., plastic, wood, bamboo. The detent insert 181 is pressed into bore 184 of the mouthpiece body 181 so that bores 186 and 185 are axially aligned. Detent 183 interfaces with a spring plunger (not shown) mounted in standoff assembly 82. Seal 182 seals the mouthpiece assembly into mouthpiece carrier assembly 84 (FIG. 4).

The removable, numbered mouthpiece assemblies 18 help to alleviate fears of spreading germs when the device 10 is shared by multiple users.

The mouthpiece assembly 18 can be swapped-out for a hose or tubing connector. This allows a bubbler or water pipe, i.e., a liquid filled container through which the vapor flows, to be connected to the device to humidify and further cool the vapor before inhalation.

The mouthpiece assembly 18 can be inserted into bore 163 of the cylinder bottom plate 45 so that spent herb can be blown from the bowls 12 in cartridge 14.

FIGS. 25-34 illustrates a variation in the design of the multi-portion vaping device 10, namely, the herb bowls 12 are removed from the cylinder plate 160 and are integrated into the flow bodies 111 to become bowl/bed support assemblies 109.

FIG. 25 is a top isometric view of a carrier 14 that contains bowl/bed support assemblies 109.

FIG. 26 is an exploded top isometric view of the cartridge 14, which consists of: cylinder pin 84, cylinder top plate 28, upper glide plate 170, cylinder plate assembly 32 (which contains the bowl/bed support assemblies 109), lower glide plate 171, cylinder bottom assembly 22, spring 24 and tie screw 106.

FIG. 27 is an exploded top isometric view of cylinder plate assembly 32, which consists of a cylinder plate 160, six (6) bowl/bed support assemblies 109, identification label 173, and spring plunger 106.

FIG. 28 is a top isometric view of the cylinder plate 160. Bowl/bed support assemblies 109 slide into bores 177 from the underside. The depth of counterbore 174 is such that cylinder top plate 128 sits essentially flush with the top surface 150 of cylinder plate 160. Notches 176 allow LEDs 199 (see FIG. 4) to shine through and illuminate the cylinder top plate 128. Counter-bored boss 179 accepts identification label 173.

FIG. 29 is a bottom isometric view of the cylinder plate 160. O-ring 116 of bowl/bed support assemblies 109 seals in bores 178. The depth of counterbore 175 is such that the lower glide plate 171 sits a bit (0.010-0.020") proud if the bottom surface 151 of cylinder plate 160. Boss 131 helps to correctly orient lower glide plate 171.

Glide plates 170 and 171 should be made of a smooth, low friction material, e.g., Teflon.

A bowl/bed support assembly 109, as shown in FIGS. 30 and 31 consists of: a flow body 111, a screen 112, a perforated disk 115, and an O-ring 116. All above listed components of the bowl/bed support assembly 109 are aligned axially. An O-ring groove 118 of the flow body 111 and counter bore 178 in cylinder plate 160 are sized so that when assembled, O-ring 116 will compress into the counter bore 178 of cylinder plate 160 with a light finger pressure and the bowl/bed support assembly 109 will be loaded against the lower glide plate 171 when the cartridge 14 is assembled. The screen 112 has a mesh fine enough to keep herb from passing through, but not so fine as to result in excessive pressure drop of inhalation vapor flow. Preferred material for screen 112 is stainless steel. Screen 112 has an outside diameter that allows for a slip fit into counter bore of the flow body 111.

Each bowl/bed support assembly 109 has an integrated bowl 12 and bed support. The bed support acts as both a screen and a heat sink to filter and cool the inhaled vapor. The components of the bowl/bed support assembly 109 are pressed together with an interference fit during manufacture. They are not made to be disassembled.

As shown in FIGS. 32-34, bowl/bed assemblies 109 can be manufactured with different bowl volumes, e.g.: small (0.013 $in^3$), medium (0.018 $in^3$), and large (0.025 $in^3$). Bowl/bed support assemblies 109 with different bowl volumes are interchangeable since they have the same outer dimensions.

The cartridge 14 depicted in FIGS. 25-34 is designed so that bowl 12 selection is very easy to accomplish because there are only two outer diameter surfaces for the user to interface with, one that rotates, i.e., the cylinder plate assembly 32, and one that is stationary, i.e., the cylinder bottom assembly 22. With the first design depicted for the cartridge 14 there is one outer rotary surface, i.e., cylinder plate assembly 32 that is sandwiched between two outer stationary surfaces, i.e., the top cylinder plate 28 and the cylinder bottom assembly 22, which makes grasping and rotating the cylinder plate assembly 32 more difficult.

It is to be understood that the above-described embodiments of the present invention are merely illustrative of or explaining the principles of the invention and are not to be construed as limiting the invention. Therefore, any modification, equivalent replacement, improvement and the like made without departing from the spirit and scope of the present invention should be included in the protection scope of the present invention. Further, it is intended that the appended claims cover all such variations and modifications as fall within the scope and boundaries of the appended claims or the equivalents of such scope and boundaries.

The invention claimed is:

1. A multi-portion vaping device comprising:
- a carrier comprising:
  - a cap assembly comprising:
    - a heater assembly;
    - a cap peg;
    - a spring, wherein the spring biases the cap peg; and
    - a lever assembly including a release button, wherein the cap peg is movable by depressing and releasing the release button;
- a mouthpiece; and
- a cartridge removably mounted to the carrier, the cartridge comprising:
  - a cylinder top plate defining an herb aperture; and
  - a cylinder bowl plate that includes a plurality of herb bowls each sized to contain a volume of fresh herb,
- wherein the mouthpiece, heater assembly, and cap peg define at least a portion of a vapor flow path, further wherein
- the cylinder bowl plate is rotatable with respect to the vapor flow path such that the plurality of herb bowls can be selectively fluidly coupled with the vapor flow path, and air within the vapor flow path is heated by the heater assembly prior to entering a selected one of the plurality of herb bowls, and the cap peg is configured to selectively contact the cylinder top plate to allow unheated ambient air to flow into the vapor flow path when the cap peg is spaced from the cylinder top plate, and configured to selectively seal the herb aperture to prevent unheated ambient air from flowing into the vapor flow path in the selected one of the plurality of herb bowls.

2. The multi-portion vaping device of claim 1 wherein when a cartridge release mechanism is activated, the cartridge can be pulled away from the carrier for removal from the carrier or pushed into the carrier for installation of the cartridge into the carrier.

3. The multi-portion vaping device of claim 1, wherein the mouthpiece can be inserted into a hole formed in a bottom section of the cartridge so that spent herb compound can be blown out from the herb bowls as necessary.

4. The multi-portion vaping device of claim 1, wherein each of the plurality of herb bowls includes an integrated bed support, which acts as both a screen and a heat sink to filter and cool the vapor.

5. The multi-portion vaping device of claim 1, wherein each cartridge and each of the plurality of herb bowls herb bowl have-include distinct unique, easy to read, identification markings.

6. The multi-portion vaping device of claim 1, wherein one or more magnets hold the cartridge in place in the carrier when a cartridge release mechanism is activated.

7. The multi-portion vaping device of claim 1, wherein depressing and releasing the release button sends thermal pulses through the selected one of the plurality of herb bowls.

8. The multi-portion vaping device of claim 1, further comprising:
- a male feature disposed on the carrier; and
- a female feature disposed on a bottom surface of a cylinder plate assembly, wherein the male feature interfaces with the female feature to install the cartridge on the carrier.

9. The multi-portion vaping device of claim 1, wherein heated air in the vapor flow path vaporizes compounds in the volume of fresh herb.

10. The multi-portion vaping device of claim 9, wherein the heater assembly includes an electrically resistive element.

11. The multi-portion vaping device of claim 10, wherein the electrically resistive element is a wire wound heater coil.

12. The multi-portion vaping device of claim 11, wherein the wire wound heater coil is coaxial.

13. The multi-portion vaping device of claim 12, wherein air within the vapor flow path passes through and between the wire wound heater coil and a coil housing results in heat transfer between the wire wound heater coil and the air.

14. The multi-portion vaping device of claim 9, wherein-further comprising:
- a top distribution screen that distributes heated air flow throughout the volume of fresh herb.

15. The multi-portion vaping device of claim 10, wherein at least one portion of the heater assembly is in contact with a top distribution screen.

16. The multi-portion vaping device of claim 14, wherein the top distribution screen has perforated, radially canted formed slots.

* * * * *